US006707883B1

(12) United States Patent
Tiearney, Jr. et al.

(10) Patent No.: US 6,707,883 B1
(45) Date of Patent: Mar. 16, 2004

(54) X-RAY TUBE TARGETS MADE WITH HIGH-STRENGTH OXIDE-DISPERSION STRENGTHENED MOLYBDENUM ALLOY

(75) Inventors: Thomas Carson Tiearney, Jr., Waukesha, WI (US); Srihari Balasubramanian, Clifton Park, NY (US); Pazhayannur Ramanathan Subramanian, Niskayuna, NY (US); Gregory Alan Steinlage, Milwaukee, WI (US); Mark Ernest Vermilyea, Niskayuna, NY (US); Liqin Wang, Brookfield, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/429,443

(22) Filed: May 5, 2003

(51) Int. Cl.[7] ..... H01J 35/10
(52) U.S. Cl. ..... 378/144; 378/143
(58) Field of Search ..... 378/144, 143, 378/119

(56) References Cited

U.S. PATENT DOCUMENTS

| | | | | | |
|---|---|---|---|---|---|
| 4,953,190 | A | | 8/1990 | Kukoleck et al. | 378/129 |
| 5,943,389 | A | * | 8/1999 | Lee | 378/144 |
| 6,157,702 | A | | 12/2000 | Reznikov et al. | 378/144 |
| 6,214,474 | B1 | | 4/2001 | Barbist et al. | 428/469 |
| 6,289,080 | B1 | | 9/2001 | Hasz et al. | 378/143 |
| 6,390,876 | B2 | | 5/2002 | Benz et al. | 445/28 |
| 6,421,423 | B1 | | 7/2002 | Warren | 378/144 |
| 6,430,264 | B1 | * | 8/2002 | Lee | 378/144 |
| 6,477,236 | B1 | * | 11/2002 | Anno et al. | 378/144 |
| 6,487,275 | B1 | * | 11/2002 | Baba et al. | 378/144 |
| 6,560,315 | B1 | * | 5/2003 | Price et al. | 378/144 |

OTHER PUBLICATIONS

Download from website www.pittsburghmaterialstech.com/news.html (downloaded in late 2002 or early 2003 by Dennis Flaherty).

* cited by examiner

*Primary Examiner*—Craig E. Church
*Assistant Examiner*—Irakli Kiknadze
(74) *Attorney, Agent, or Firm*—Ostrager Chong & Flaherty LLP

(57) ABSTRACT

An X-ray target material comprising an oxide-dispersion strengthened Mo (ODS-Mo) alloy. ODS-Mo refers to molybdenum strengthened by a fine dispersion of insoluble oxide particles of one or more of the following compounds: $La_2O_3$, $Y_2O_3$ and $CeO_2$. ODS—Mo alloy improves upon the prior art by providing higher and more uniform strength and creep resistance over the applicable temperature range of large brazed graphite targets. This, in conjunction with higher-strength graphite, allows the target to spin faster without causing graphite burst, thus providing improvement in peak power. The recrystallization temperature of the fabricated material is high enough to maintain original properties through all target processing, including a very high-temperature braze cycle.

32 Claims, 3 Drawing Sheets

As-rolled

2000°C/1h/vac

X-RAY TUBE TARGETS MADE WITH HIGH-STRENGTH OXIDE-DISPERSION STRENGTHENED MOLYBDENUM ALLOY

BACKGROUND OF THE INVENTION

The present invention relates to a high-performance X-ray generating target. More particularly, the invention is directed to a high-performance rotating X-ray tube anode structure having an improved target and a related method of manufacturing such an anode structure.

X-rays are produced when electrons are released in a vacuum within an X-ray tube, accelerated and then abruptly stopped. The electrons are initially released from a heated, incandescent filament. A high voltage between an anode and a cathode accelerates the electrons and causes them to impinge upon the anode. The anode, usually referred to as the target, can be a rotating disc type so that the electron beam constantly strikes a different point on the target surface. The X-ray tube contains the cathode and anode assembly, which includes the rotating disc target and a rotor that is part of a motor assembly that spins the target. A stator is provided outside the X-ray tube vacuum envelope, overlapping about two-thirds of the rotor. The X-ray tube is enclosed in a protective casing having a window for the X-rays that are generated to escape the tube. The casing is filled with oil to absorb heat produced by the X-rays.

The rotating X-ray tube target typically includes a refractory metal target substrate and a target focal track of an X-ray emitting metal joined to the target substrate along an interface. Tungsten alone and tungsten alloyed with rhenium are commonly used to form the focal track in X-ray targets. X-ray targets formed wholly from tungsten or from tungsten alloys, wherein tungsten is the predominant metal, are characterized by high density and weight. Additionally, tungsten is notch sensitive and extremely brittle and is thereby subject to catastrophic failure. Because of these shortcomings, X-ray targets typically comprise a tungsten or tungsten alloy target focal track and a target substrate of another metal or alloy. Typically, molybdenum and molybdenum alloys are used for the target substrate.

X-ray tubes used for medical imaging generate X-rays by bombarding the layer of material making up the target focal track with high-power electrons. The focal track contains elements with high atomic number (such as tungsten and rhenium) and is integrally attached to a disc of a high-conductivity refractory metallic material such as TZM (a molybdenum alloy containing small amounts of titanium, zirconium and carbon). The TZM alloy disc in turn is bonded onto a graphite disc by a braze layer composed of titanium, vanadium or zirconium alloys. In order to dissipate the intense heat generated on the focal track, the target disc is rotated to speeds in excess of 8,400 rpm. Additionally, the high-conductivity target disc conducts the heat generated under the focal track to the brazed graphite block, which acts as thermal storage material or a heat sink.

The demand for ever-improving X-ray image quality in conjunction with the need for computerized tomography (CT) systems to perform high-speed cardiac imaging necessitates the use of high peak power (in excess of 70 kW), high target rotation speeds, as well as high gantry rotation speeds. These in turn drive up the thermal and structural loading of the target material beyond its current capabilities. Thus, there is a need for target materials with (a) higher strength and creep resistance than those for the TZM alloy to meet the thermal and structural demands placed by the use of high peak power and high rotation speeds, and (b) lower target weight compared to the current TZM/brazed graphite configuration to offset the impact of higher g-loads at faster gantry speeds on bearing stresses.

Efforts to address these requirements in the past have included the potential use of targets made of carbon-carbon composite materials. While these materials offer substantial advantages in terms of weight savings and thermal storage, they also have inherent drawbacks, namely their limited toughness. In addition, carbon-carbon composite materials have issues with fabricability, burst strength vacuum compatibility, and material homogeneity. Consequently, their implementation in CT X-ray systems is still under development.

BRIEF DESCRIPTION OF THE INVENTION

The present invention is directed to an X-ray target material for use in rotating anode X-ray tubes in which the TZM material used in current X-ray targets is replaced with an oxide-dispersion strengthened Mo (ODS-Mo) alloy. ODS-Mo refers to molybdenum strengthened by a fine dispersion of insoluble oxide particles of one or more of the following compounds: $La_2O_3$, $Y_2O_3$ and $CeO_2$.

One aspect of the invention is an X-ray tube anode comprising a target substrate made of oxide-dispersion strengthened molybdenum alloy, a metal track formed on the target substrate and comprising X-ray emitting metal, a graphite mass brazed on the rear of the substrate, and an emissive coating applied to open ODS-Mo surfaces.

Another aspect of the invention is an apparatus comprising a substrate made of oxide-dispersion strengthened molybdenum alloy and a metal track formed on the substrate and comprising X-ray emitting metal, wherein the substrate has a generally circular outer periphery and a central hole, and the track is generally annular and concentric with the outer periphery of the substrate.

A further aspect of the invention is a method of manufacturing an X-ray tube anode, comprising the following steps: extruding molybdenum powder alloyed with dispersed oxide to form a workpiece; upset forging the workpiece to form a target substrate in the shape of a circular disc with a circular cylindrical shaft attachment projecting from the periphery of a central hole in the disc; and coating an annular section on one side of the target substrate with a layer of X-ray emitting metal.

A further aspect of the invention is a method of manufacturing an X-ray tube anode, comprising the following steps: extruding molybdenum powder alloyed with dispersed oxide to form a workpiece; plate rolling to more than 92% cross-section reduction followed by cutting of right circular discs from the plate; and coating an annular section on one side of the target with a layer of X-ray emitting metal.

Yet another aspect of the invention is an anode assembly for an X-ray tube, comprising a rotating disc target and a rotor that is part of a motor assembly that spins the target, wherein the disc target comprises a target substrate made of oxide-dispersion strengthened molybdenum alloy, a metal track formed on the target substrate and comprising X-ray emitting metal, a graphite mass brazed to the rear of the substrate, and an emissive coating applied to open ODS-Mo surfaces.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
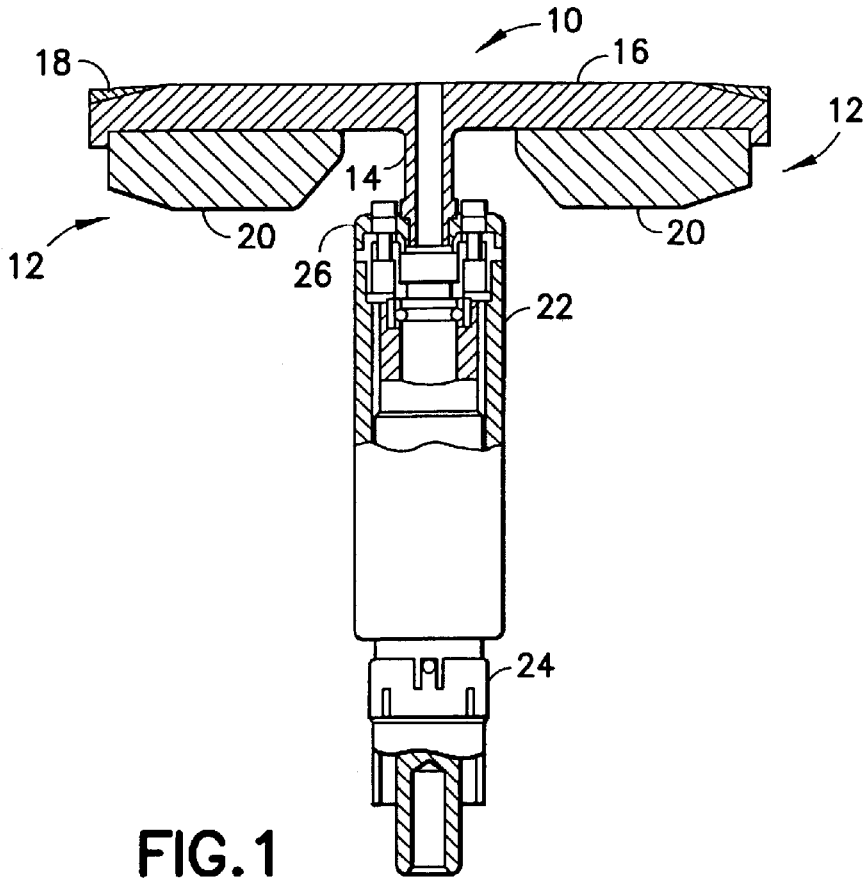
FIG. 1 is a drawing showing a partial sectional view of a conventional X-ray tube target and stem assembly.
Figure 2:
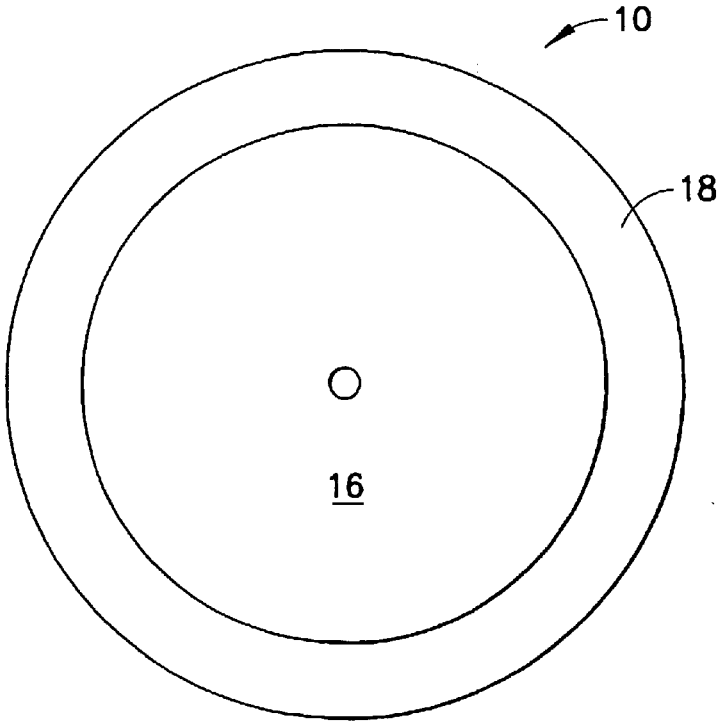
FIG. 2 is a drawing showing a top view of the assembly of FIG. 1 showing the target substrate and focal track.

FIGS. 1 and 2 are schematic views of portions of a conventional X-ray tube 10 that comprises a rotating anode assembly 12. The anode assembly 12 comprises a target substrate 16 (typically made of molybdenum alloy TZM), a stem 14 integrally formed with the target substrate 16, and a target focal track 18 (typically made of a tungsten-rhenium alloy) formed on the upper surface of the target substrate. The target substrate 16 is backed by a graphite ring 20, which is brazed to the target substrate and forms part of the anode assembly 12. Electrons generated by a cathode (not shown) impinge on the focal track 18. The X-ray emitting metal of focal track 18 emits X-rays in response to the impingement of electrons.

The anode assembly 12 is rotated by an induction motor comprising cylindrical rotor 22 built around a bearing housing 24. The bearing housing 24 supports the entire rotating anode assembly 12. The anode assembly 12 is mechanically coupled to the rotor 22 via the stem 14 and a hub 26. The bearing housing 24 contains bearings (not shown) to facilitate rotation of the anode assembly 12. The rotor 22 is driven by a stator induction motor (not shown).

In a typical X-ray tube, the anode and cathode assemblies are sealed in a vacuum envelope (not shown). The stator is provided outside the vacuum envelope. The X-ray tube is enclosed in a protective casing (not shown) having a window for the X-rays that are generated to escape the tube. The casing is filled with oil to absorb heat produced as a result of X-ray generation.

In accordance with various embodiments of the present invention, the TZM material used in current X-ray targets is replaced with an oxide-dispersion strengthened molybdenum (ODS-Mo) alloy. In one embodiment, the ODS-Mo alloy comprises a crystalline matrix of molybdenum with a dispersion of fine insoluble oxide particles. The oxide may be selected from the following compounds: lanthanum oxide ($La_2O_3$), cerium oxide ($CeO_2$) and yttrium oxide ($Y_2O_3$). In the case of lanthanum oxide, the amount of lanthanum oxide is about 2 vol. %.

Figure 3:
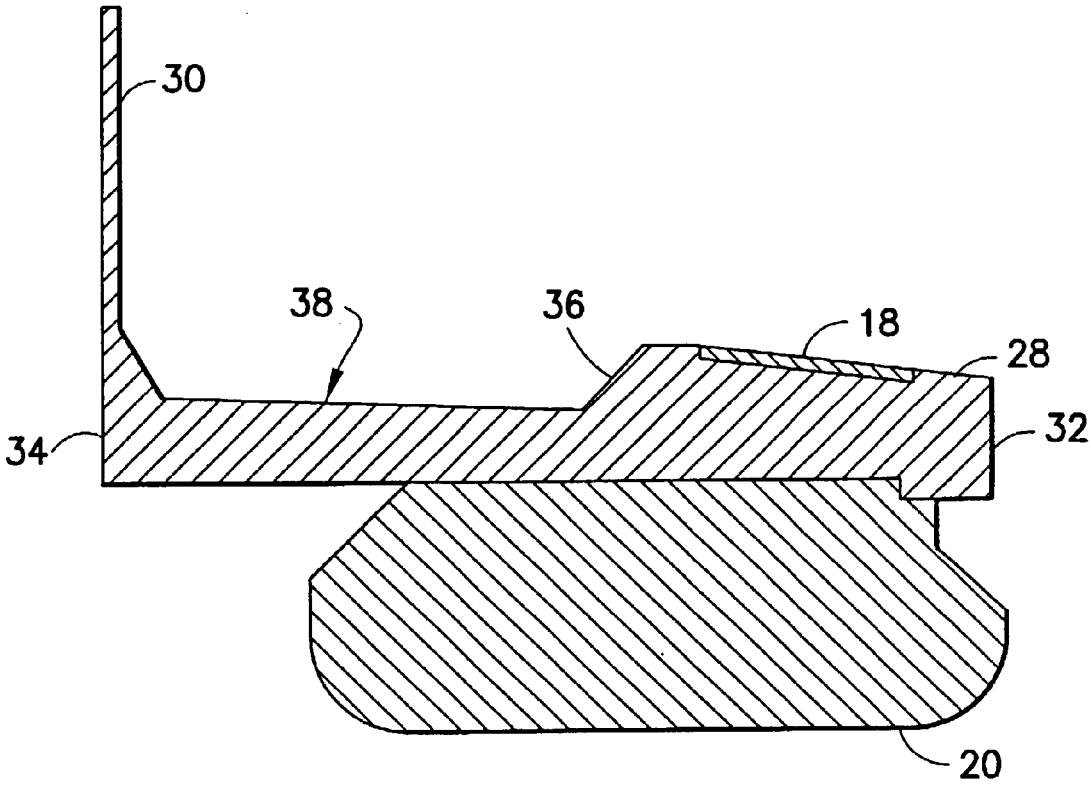
FIG. 3 is a drawing showing a sectional view of an X-ray tube target and stem assembly in accordance with a preferred embodiment of the present invention.

The structure of a rotating anode in accordance with one embodiment of the invention is shown in FIG. 3. A disc-shaped target substrate 28 is made of ODS-Mo alloy. The target substrate has a generally circular outer periphery 32 and a generally circular central hole 34. Because of the high density of molybdenum alloys, the disc volume must be kept low to be able to operate the bearings at an acceptable stress range. To reduce the total weight of the target substrate 28, the average thickness of a radially inner annular section of the substrate is less than the average thickness of a radially outer annular section, these annular sections being connected by a section 36 in which the substrate thickness increases (e.g., linearly) in a radially outward direction. An annular focal track 18 is formed on the front surface of the relatively thicker radially outer annular section of the substrate 28. The focal track 18 may take the form of a layer of W-Re alloy applied by a coating method.

The vertical structure 30 in FIG. 3 is the circular cylindrical shaft attachment to the rotor (not shown). The shaft attachment is important for ensuring optimum target balance retention regardless of the material chosen for the disc. The shaft attachment 30 and the target substrate 28 are made of the same material, i.e., ODS-Mo alloy. This shaft can either be formed in-situ with the disc by upset forging, or ODS-Mo bar can be inertia welded to the disc.

A generally annular graphite heat storage ring 20 is brazed to the rear surface of the target substrate 28. The size and shape of the graphite ring 20 are optimized to provide the best compromise between bearing load and heat storage. The end result is a much lighter X-ray target with concomitant reduction in loads on the bearings used in the rotating X-ray anode.

ODS-Mo alloy improves upon the prior art by providing higher and more uniform strength and creep resistance over the applicable temperature range of large brazed graphite targets. This, in conjunction with higher-strength graphite, allows the target to spin faster without causing graphite burst, thus providing improvement in peak power. The use of relatively low-strength TZM alloy in conjunction with higher-strength graphite would be pointless since the TZM alloy yields at higher anode rotation speeds, causing even the higher-strength graphite to achieve fracture strains.

The replacement of TZM with ODS-Mo offers an additional benefit in terms of a 600° C. increase in recrystallization temperature, thereby allowing strength and creep resistance retention in the targets to much higher temperatures in comparison to the capabilities provided by TZM. The recrystallization temperature of the fabricated material is high enough to maintain original properties through all target processing, including a very high-temperature braze cycle when the graphite ring is attached. Mechanical properties of TZM are reduced by ~40% after recrystallization.

It is well known that of the total energy involved in an electron beam striking an X-ray target, only about 1% of the energy is converted into X-radiation with the remainder of about 99% being converted into heat. The thermal emittance of X-ray tube anode targets can be increased by coating the target surface outside of the focal track (e.g., the front surface and the outer peripheral surface) with various coating compounds. Such an emissive coating on the front surface of the target substrate 28 has been indicated by reference numeral 38 in FIG. 3. The emitted heat is radiated to the vacuum envelope of the X-ray tube and ultimately transferred to the oil circulating in the tube casing. A variety of thermal emittance-enhancing coatings can be used. For example, U.S. Pat. No. 4,953,190 teaches the use of a metal oxide coating comprising $Al_2O_3$ present in an amount of 50 to 80 wt. % and $TiO_2$ together with $ZrO_2$ or $La_2O_3$ present in an amount of 50 to 20 wt. % with the $TiO_2$ being present with respect to the $ZrO_2$ or $La_2O_3$ in a ratio in the range of 1:1 to 10:1. However, a wider range of mixed oxide percentages from oxides such as alumina, titania, zirconia, yttria, lanthana, and calcia can also be used. The emissivity of the finished coating should be greater than or equal to 0.8 to provide enhanced heat dissipation from the target by radiation.

Oxide coatings are used on many conventional target types, but on targets that operate at lower temperatures where the reaction of carbon from the TZM alloy with the oxides is not a problem. As one keeps pushing these materials harder, the temperature increases and limits the TZM alloy, unless it is coated with a barrier layer first, as taught in U.S. Pat. No. 6,214,474. In contrast, the low carbon content of the ODS-Mo alloys versus the prior art carbide-strengthened alloys allows the metallic surfaces of the target not brazed to graphite to be emissively coated by state-of-the-art oxide coatings without the need for an intermediate (i.e., barrier) layer. In addition, the low carbon content would produce less carbon monoxide evolution into the X-ray tube from the target material run at high temperatures.

Figure 4:
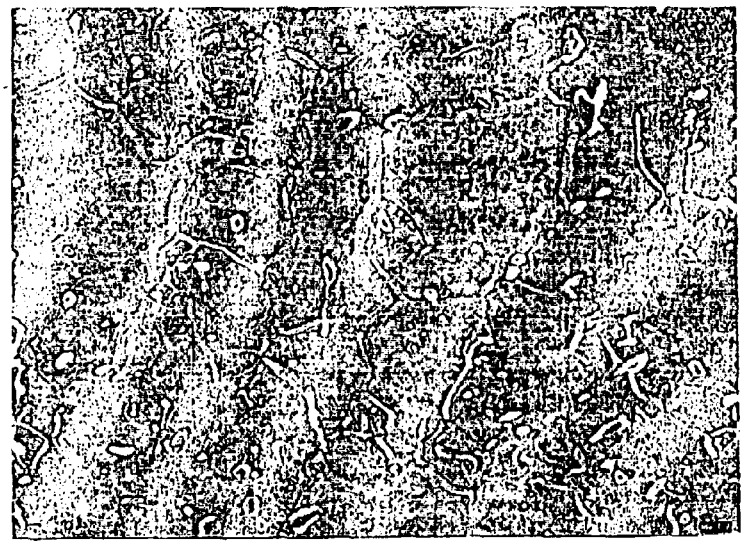
FIGS. 4 and 5 are optical micrographs of ODS-Mo alloy in the as-rolled condition and after high-temperature exposure at 2000° C. for 1 hour, respectively.
Figure 5:
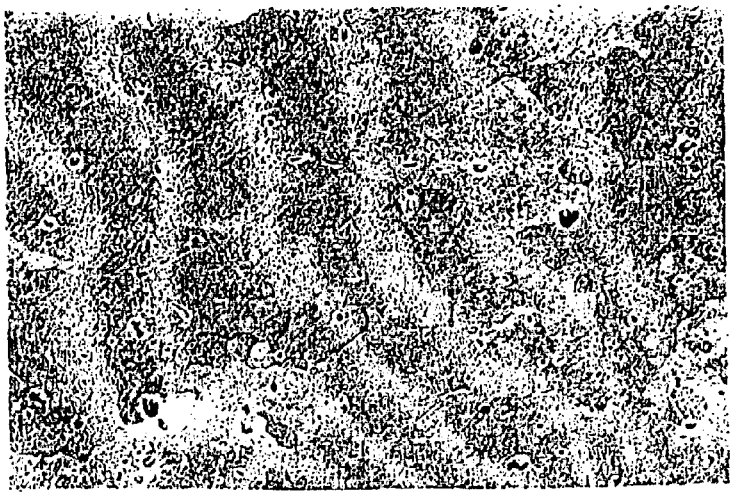

Prototype sheets of lanthanum oxide-dispersion strengthened molybdenum alloy having dimensions (1" L×1" W×0.375" T) were fabricated. In order to assess the recrystallization temperature of the ODS-Mo (with $La_2O_3$) alloy, specimens were subjected to high-temperature exposures at 1400, 1500, 1600, 1700, 1800, 1900, and 2000° C. for 1 hour in vacuum. Metallographic examination of the exposed specimens was performed. The resultant microstructure of a ODS-Mo (with $La_2O_3$) specimen exposed at 2000° C. is shown in the optical micrograph presented as FIG. 5, while a specimen in the as-rolled condition is shown in FIG. 4. The deformation substructure produced by thermo-mechanical working of the ODS-Mo sheet is still visible in FIG. 5 after the 2000° C./1 hr exposure, indicating that the alloy had still not recrystallized. The ODS-Mo (with $La_2O_3$) microstructure as fabricated and after exposure at 2000° C. for 1 hour in vacuum showed essentially no difference.

The as-processed ODS-Mo (with $La_2O_3$) specimens had molybdenum grains ranging from 10 to 50 microns in size, as well as $La_2O_3$ particles ranging in size from 500 nm to 4 microns. The $La_2O_3$ particles had an ellipsoid or plate-shaped morphology. The oxide particles were located at molybdenum grain boundaries, grain triple points, as well as distributed within the molybdenum grains.

Fabrication options required to provide ODS-Mo with its stellar properties also result in uniformly fully dense material, leading to improved balance retention over the state-of-the-art fabrication method of powder pressing, sintering and low work forging. Fabrication options for making this target shape include extrusion followed by plate rolling or extrusion followed by upset forging, both of which achieve the desired 88–96% (92–94% in the preferred embodiment) work levels required for the outstanding properties already alluded to. Extrusion is common to both of these methods, but the means to apply the additional work levels are different. For the plate rolling method, the extrusion is made rectangular through a second extrusion and then passed through successively tighter rolling mills to achieve the final thickness. Circular discs are then cut from the plate and ODS-Mo bar is inertia welded to them. For the upset forge method, the round extrusion is pancake forged between two dies with holes in the center for the shaft protrusion, yielding two parts per forge operation that are then cut apart. Because of the use of these fabrication methods, the W-Re alloy layer on finished targets must be applied by a coating method instead of the state-of-the-art powder metallurgy method. In so doing this though, the resultant precision of the layer dimensions enable another improvement in retained balance of the finished target.

The invention provides the following advantages: X-ray target material capability to meet the thermal and structural demands placed by the use of high peak power and high rotation speeds; X-ray target material that retains its mechanical properties to very high target bulk temperatures; and a lower weight target design than that capable of the current TZM alloy, resulting in lower bearing stresses under the operating environment. In addition, the resulting substantial improvement (−2×) in yield and creep strength of ODS-Mo over TZM alloy, and the use of higher-strength graphite, allows for very high rotational speeds (>13,000 rpm) for the target. This significantly reduces the local thermal loading under the electron beam. Also, the new X-ray target material could be introduced into an existing X-ray tube design with minimal design/process changes to other components in the tube.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment -disclosed as the best mode contemplated for carrying out this invention, but that the invention will include all embodiments falling within the scope of the appended claims.

What is claimed is:

1. An X-ray tube anode comprising a target substrate made of oxide-dispersion strengthened molybdenum alloy and a metal track formed on said target substrate and comprising X-ray emitting metal.

2. The X-ray tube anode as recited in claim 1, wherein said X-ray emitting metal is tungsten—rhenium.

3. The X-ray tube anode as recited in claim 1, wherein said oxide-dispersion strengthened molybdenum alloy comprises lanthanum oxide particles dispersed in a crystalline matrix of molybdenum.

4. The X-ray tube anode as recited in claim 3, wherein said lanthanum oxide particles range in size from about 500 nm to 4 microns.

5. The X-ray tube anode as recited in claim 3, wherein said molybdenum alloy comprises a crystalline matrix of molybdenum grains that range in size from 10 to 50 microns.

6. The X-ray tube anode as recited in claim 1, wherein said oxide-dispersion strengthened molybdenum alloy comprises cerium oxide particles dispersed in a crystalline matrix of molybdenum.

7. The X-ray tube anode as recited in claim 1, wherein said oxide-dispersion strengthened molybdenum alloy comprises yttrium oxide particles dispersed in a crystalline matrix of molybdenum.

8. The X-ray tube anode as recited in claim 1, wherein said oxide-dispersion strengthened molybdenum alloy comprises approximately 2 vol. % oxide particles.

9. The X-ray tube anode as recited in claim 1, further comprising a graphite ring attached to said target substrate.

10. The X-ray tube anode as recited in claim 9, wherein said graphite ring is attached to said target substrate by means of a layer of brazing material.

11. The X-ray tube anode as recited in claim 1, further comprising a coating of a thermal emittance-enhancing material formed on at least a portion of the surface of said target substrate, said coating having an emissivity of at least 0.8.

12. The X-ray tube anode as recited in claim 11, wherein said thermal emittance-enhancing material comprises a mixture of oxides.

13. The X-ray tube anode as recited in claim 1, wherein said target substrate has a generally circular outer periphery and a central hole, and said track is generally annular and concentric with said outer periphery of said target substrate, wherein said target substrate has an annular section in which the thickness of said target substrate increases in a radial outward direction, said annular section of increasing thickness being disposed radially inward of said track.

14. The X-ray tube anode as recited in claim 13, further comprising a circular cylindrical stem projecting vertically upward from one side of said target substrate, and a graphite ring attached to the other side of said target substrate, said stem and said target substrate being made of the same material.

15. An apparatus comprising a substrate made of oxide-dispersion strengthened molybdenum alloy and a metal track formed on said substrate and comprising X-ray emitting metal, wherein said substrate has a generally circular outer periphery and a central hole, and said track is generally annular and concentric with said outer periphery of said substrate.

16. The apparatus as recited in claim 15, wherein said substrate has an annular section in which the thickness of said substrate increases in a radial outward direction, said annular section of increasing thickness being disposed radially inward of said track.

17. The apparatus as recited in claim 15, wherein said X-ray emitting metal is tungsten—rhenium.

18. The apparatus as recited in claim 15, wherein said oxide-dispersion strengthened molybdenum alloy comprises oxide particles dispersed in a crystalline matrix of molybdenum, said oxide being selected from the group consisting of lanthanum oxide, cerium oxide and yttrium oxide.

19. The apparatus as recited in claim 18, wherein said oxide-dispersion strengthened molybdenum alloy comprises approximately 2 vol.% oxide particles.

20. The apparatus as recited in claim 15, further comprising a graphite ring attached to said substrate.

21. The apparatus as recited in claim 20, wherein said graphite ring is attached to said substrate by means of a layer of brazing material.

22. The apparatus as recited in claim 15, further comprising a coating of a thermal emittance-enhancing material formed on at least a portion of the surface of said substrate, said coating having an emissivity of at least 0.8.

23. The apparatus as recited in claim 22, wherein said thermal emittance-enhancing material comprises a mixture of oxides.

24. A method of manufacturing an X-ray tube anode, comprising the following steps:

extruding molybdenum powder alloyed with dispersed oxide to form a workpiece;

upset forging said workpiece to form a target substrate in the shape of a circular disc with a circular cylindrical shaft attachment projecting from the disc; and coating an annular section on one side of said target substrate with a layer of X-ray emitting metal.

25. The method as recited in claim 24, further comprising the step of brazing a graphite ring to said target substrate on the side opposite to the side having said coated annular section.

26. The method as recited in claim 24, further comprising the step of coating said target substrate with a mixture of oxides.

27. An anode assembly for an X-ray tube, comprising a rotating disc target and a rotor that is part of a motor assembly that spins said target, wherein said disc target comprises a target substrate made of oxide-dispersion strengthened molybdenum alloy and a metal track formed on said target substrate and comprising X-ray emitting metal.

28. The anode assembly as recited in claim 27, wherein said X-ray emitting metal is tungsten, and said oxide-dispersion strengthened molybdenum alloy comprises oxide particles dispersed in a crystalline matrix of molybdenum, said oxide being selected from the group consisting of lanthanum oxide, cerium oxide and yttrium oxide.

29. The anode assembly as recited in claim 27, further comprising a graphite ring brazed to said target substrate.

30. The anode assembly as recited in claim 27, wherein said target substrate has a generally circular outer periphery and a central hole, and said track is generally annular and concentric with said outer periphery of said target substrate, wherein said target substrate has an annular section in which the thickness of said target substrate increases in a radial outward direction, said annular section of increasing thickness being disposed radially inward of said track.

31. The anode assembly as recited in claim 30, further comprising a circular cylindrical stem projecting vertically upward from one side of said target substrate and mounted to said rotor, said stem and said target substrate being made of the same material.

32. A method of manufacturing an X-ray tube anode, comprising the following steps:

extruding molybdenum powder alloyed with dispersed oxide to form a workpiece;

plate rolling to more than 92% cross-section reduction;

cutting of right circular discs from the plate; and coating an annular section on one side of the target with a layer of X-ray emitting metal.

* * * * *